United States Patent [19]

Kakurai

[11] 4,161,710

[45] Jul. 17, 1979

[54] LOADING COIL FOR ANTENNA

[76] Inventor: Tadao Kakurai, 39-28, 3-chome, Chiuo, Nakano-ku, Tokyo, Japan

[21] Appl. No.: 867,313

[22] Filed: Jan. 6, 1978

[51] Int. Cl.[2] ..... H01F 27/30; H01Q 9/22

[52] U.S. Cl. ..... 336/192; 343/749; 336/208

[58] Field of Search ..... 343/715, 749, 750; 336/192, 208

[56] References Cited

U.S. PATENT DOCUMENTS

| | | | |
|---|---|---|---|
| 2,881,428 | 4/1959 | Batchelor | 343/750 |
| 3,166,751 | 1/1965 | Roll | 343/749 |
| 4,063,206 | 12/1977 | Walker | 343/750 |

*Primary Examiner*—Eli Lieberman
*Attorney, Agent, or Firm*—Marshall & Yeasting

[57] ABSTRACT

A loading coil for the antennas of the type adapted for use in the citizen frequency band and mountable at the roof, trunk lip or rain gutter of automobiles, the device featuring a tap lead-out mechanism designed to allow tap lead-out from the loading coil with no need of soldering the lead-out wire to the coil wire and to also allow easy connection to the coaxial connector unit. There is also provided a loading coil construction designed to allow initial integral formation of both the loading coil bobbin and the connector unit for connection of the coaxial cable.

1 Claim, 3 Drawing Figures

LOADING COIL FOR ANTENNA

BACKGROUND OF THE INVENTION

1. Field of the Invention

This invention relates to the construction of a loading coil for the antennas of the type adapted for use in the citizen frequency band and mountable at the roof, trunk lip or rain gutter of automobiles.

2. Description of the Prior Art

There are known the antenna devices designed to receive the radio waves of the citizen band and mountable at the roof, trunk lip or rain gutter of automobiles, but it was hardly possible to adapt an antenna which resonates with the wavelength of the citizen band frequencies, with its own length on an automobile which moves on the road surface. Therefore, it has been generally practiced to insert a loading coil to a position close to the feeding point of the antenna to effect resonance with an antenna which resonates with a shorter wavelength than the citizen band. Also, in order to reduce the voltage standing wave ratio (V.S.W.R.) by preventing generation of the stationary waves in connecting the coaxial cable to said loading coil, it has been attempted to match the impedance of the antenna with that of the coaxial cable by leading out the tap from the middle part of the loading coil. For effecting such lead-out of the tap from the loading coil, it has been common practice to solder the lead-out wire to the coil wire and connect said lead-out wire to the coaxial connector by passing said wire through the inside of a bobbin on which the loading coil wire was wound. However, the work for leading out the tap from the loading coil and connecting it to the coaxial connector was laborious and time-consuming, and hence simplification of this tap lead-out step has been strongly requested.

Also, as the tap lead-out wire from the loading coil is connected to the coaxial connector assembly by soldering or such means, the bobbin having wound thereon the loading coil and the coaxial connector assembly have been initially formed severally from each other and they have been integrated after connecting the tap lead-out wire from the loading coil to the coaxial connector assembly. Therefore, additional labour and time has been required for forming the loading coil.

SUMMARY OF THE INVENTION

This invention, therefore, is directed to the provision of a tap lead-out mechanism which allows lead-out of the tap from the loading coil with no need of soldering the lead-out wire to the coil winding, while also allowing easy connection to the coaxial connector unit, and which can be adapted with the loading coil for the antennas of the type applicable to the citizen band of frequencies and mountable at the roof, trunk lip or rain gutter of automobiles.

It is also contemplated in this invention to provide a loading coil construction designed to allow initial integral formation of both the loading coil bobbin and the connector unit for connection of the coaxial cable.

DETAILED DESCRIPTION OF THE INVENTION

The invention is now described in detail by way of an embodiment thereof with reference to the accompanying drawings.

Figure 1:
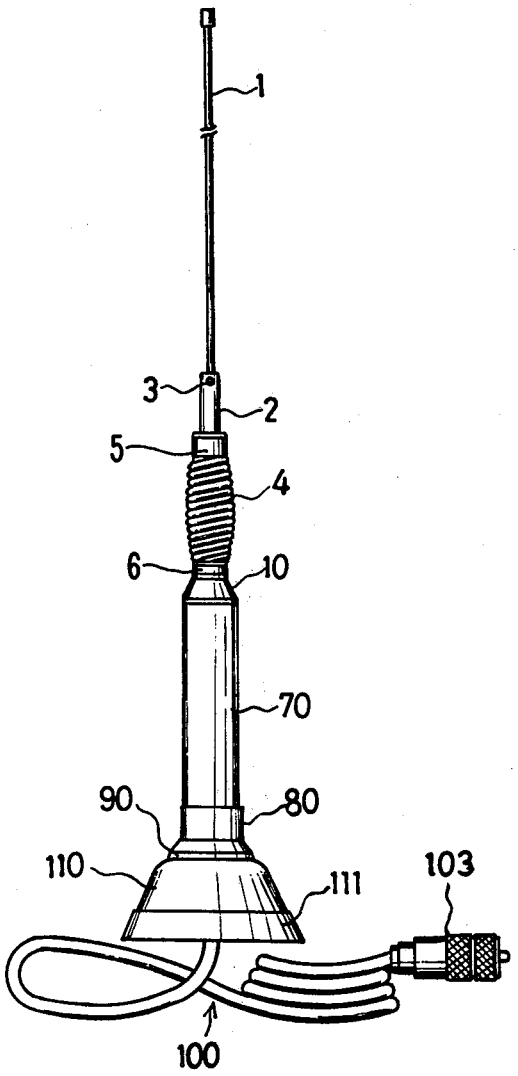
FIG. 1 is an exploded front view of the entire antenna device according to this invention applicable to the citizen frequency band and mountable on an automobile.
Figure 2:
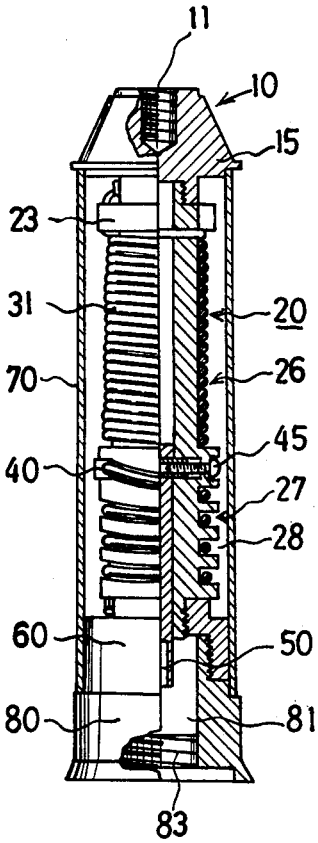
FIG. 2 is a front view, partly shown in section, of a loading coil.
Figure 3:
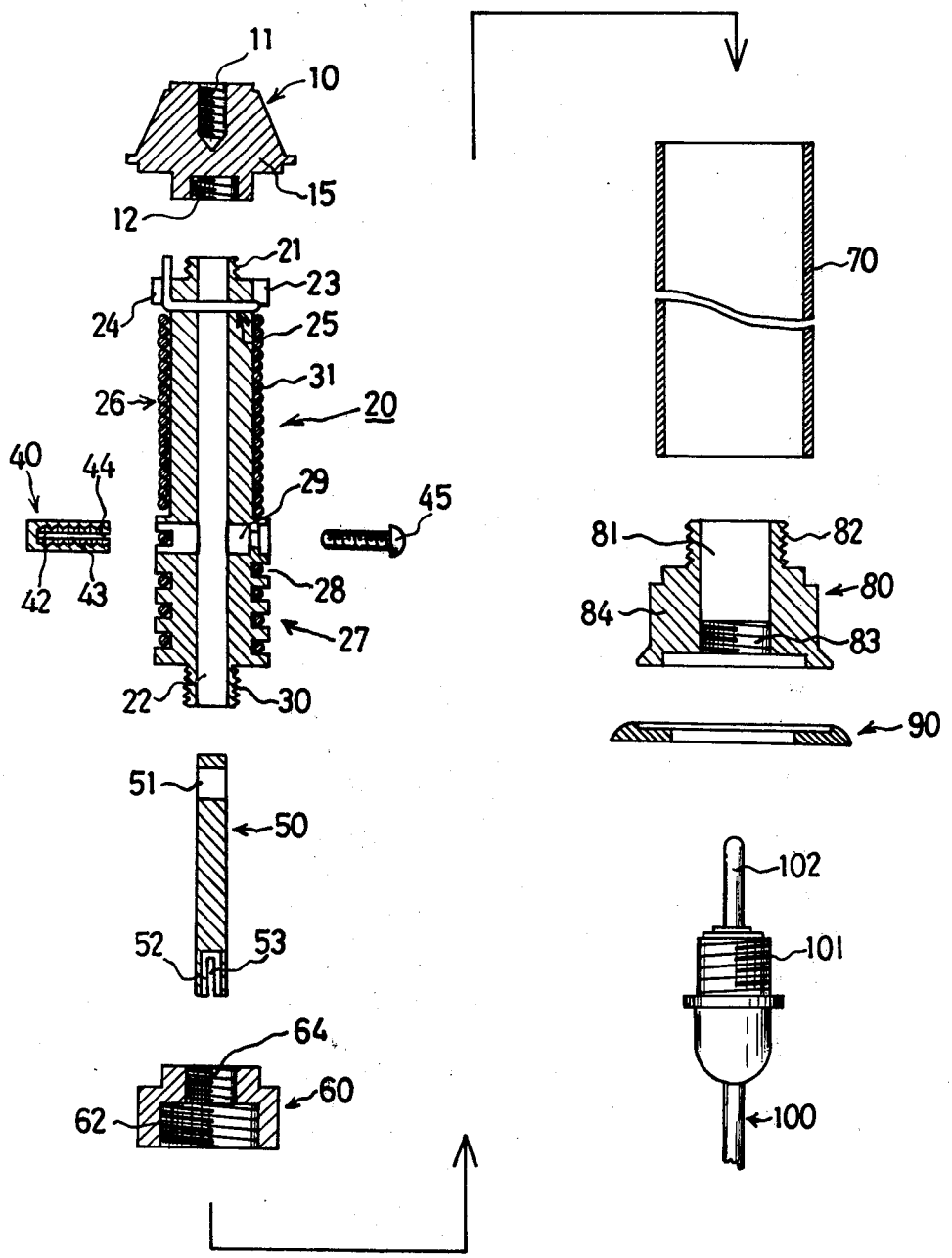
FIG. 3 is an exploded view of the loading coil.

Described first is the general construction of an antenna incorporated with the device of this invention, by referring to FIG. 1. It will be seen that a whip 1 is provided at the top of the antenna, with the lower end portion of said whip 1 being fitted into a metal stud 2 and fixed in position by a set screw 3 secured to said metal stud 2. The fixed position of the whip 1 can be freely adjusted to suit the type of the automobile adapted with the antenna or the set position of the antenna. A spring washer 5 is provided at the top end of a spring 4 to which the metal stud 2 is fixed, and an external thread of said metal stud 2 is engaged with an internal thread on the spring washer 5 to fix said members in position. Another spring washer 6 is also provided at the lower end of said spring 4. This spring washer 6 has an externally threaded lobe projecting from the center of the underside of said washer 6, and this lobe is threadedly engaged into the corresponding internally threaded hold 11 formed centrally in the upperside of an upper snap-in base 10 of the loading coil assembly. At the lower end of the loading coil assembly is provided a lower snap-in base 80 which is set on a mounting cup 110 through a rubber washer 90, said mounting cup 110 being properly set on the automobile roof through a rubber washer 111. The thus constructed antenna is connected to an end of a coaxial cable 100 which is connected at its other end to the input/output terminal of a receiver/transmitter.

Concerning now the loading coil assembly, it has at its upper end an upper snap-in base 10 which has formed centrally in its upperside portion the internally threaded hole 11 for receiving the corresponding externally threaded lobe of the spring washer 6 and which is also provided at its middle part with a flange 15 for holding the coil sleeve 70. It has also formed centrally in its underside portion an internally threaded hole 12 for receiving the corresponding externally threaded lobe 21 of a coil bobbin 20.

The coil bobbin 20 on which the loading coil is wound has formed centrally along its length a through-hole 22 into which a connector pin 50 is inserted. At the top of said bobbin 20 is provided a flange 23 against which the lower end face of the upper snap-in base 10 abuts, said flange 23 being also formed with a vertical slot 24 for fixing an end of the coil wire 31. Provided below said flange 23 is a densely wire-winding portion 26 around which the coil wire is wound densely. At the top end of said dense wire winding portion 26 is formed a hole 25 extending transversely through the coil bobbin 20 at the position of said slot 24 in the flange 23. Provided below and in continuance to said dense winding portion 26 is a sparse coil wire winding portion 27 provided with a spiral groove 28 for sparsely winding the coil wire 31 thereon. At the top of this sparse winding portion 27 is formed a hole 29 adapted for inserting a cotter pin 40 horizontally in agreement with the groove 28. Extending from the underside of said sparse winding portion 27 is an externally threaded lobe 30 engaged with a ring 60. The connector pin 50 is inserted into the central through-hole 22 of the coil bobbin 20 such that a hole 51 formed at the upper end of said connector pin is registered with the hole 29 in the sparse winding portion 27. Said connector pin 50 is provided with a hole 52 centrally at its lower end which hole is provided with slits 53 to permit spreading out of the lower end of the pin 50. The cotter pin 40 is inserted into the hole 29 of the coil bobbin 20 which pin is closed at its one end and open at its other end and is provided internally thereof with an internal thread 43 and slits 44 in opposition to the threads to permit spreading out of the cotter pin 40. The threaded hole in the cotter pin 40 is of a size to allow insertion of the coil wire 31. A screw 45 is passed through the hole 29 from its one end and engaged into the internally threaded portion 43 of the cotter pin 40 to fix it in position. The externally threaded lobe 30 at the bottom of the coil bobbin 20 is threadedly engaged into the corresponding internally threaded hole 64 in the upper portion of the ring 60. In the lower portion of said ring 60 is also provided an internally threaded hole 62 into which the correspondingly threaded lobe of the lower snap-in base 80 is engaged. Said lower snap-in base 80 is formed with a hole 81 centrally at its upper portion around which an external thread 82 is provided such that this external thread is engaged with the corresponding internal thread in the hole 62 in said ring 60. Also formed centrally in the lower portion of said snap-in base 80 and in communication with the hole 81 is an internally threaded hole 83 into which the corresponding externally threaded lobe 101 of the coaxial connector 100 is engaged. In order to protect the loading coil against weather, it is covered with a coil sleeve 70 adapted between the underside of the flange 15 of the upper snap-in base 10 and the upperside of the flange 84 of the lower snap-in base 80.

We will now describe the method of assemblage of the loading coil unit. First, the internally threaded hole 12 of the upper snap-inbase 10 is threadedly fitted over the externally threaded lobe 21 of the coil bobbing 20 to thereby secure the upper snap-in base 10 to the coil bobbin 20. Then the connector pin 50 is inserted bottomwise into the through-hole 22 of the coil bobbin 20, and after positioning the hole 51 of the connector pin 50 in registration with the hole 29 of the coil bobbin 20, said connector pin 50 is secured to the coil bobbin 20 by an adhesive. Then the externally threaded lobe 30 at the lower end of the coil bobbin 20 is engaged with the corresponding internally threaded hole 64 of the ring 60 to secure the ring 60 to the coil bobbin 20. The coil wire 31 is wound densely around the dense winding portion 26 of the coil bobbin 20 and then coiled sparsely along the groove 28 of the sparse winding portion 27. The upper end portion of the coil wire 31 is inserted and fixed in the hole 25 and the wire end further extending out from said hole 25 is passed through the slot 24 and soldered to an outer peripheral part of the internally threaded hole 12 in the upper snap-in base 10. The lower end of the coil wire 31 is connected by soldering to an outer peripheral part of the internally threaded hole 64 in the ring 60. The surface insulator on the coil wire portion positioned in the hole 29 of the sparse winding portion 27 is stripped off, and with this stripped coil wire portion being held by the slits 44 in the cotter pin 40, said cotter pin is inserted into the hole 29 while the screw 45 is also inserted into said hole 29 from its opposite side and threadedly engaged with the internal thread 43 on the internal wall of said cotter pin 40 to thereby secure said cotter pin 40 to the coil bobbin 20. As the slitted part of the cotter pin 40 is spread out by the screw 45, the cotter pin 40 is securely pressed against the internal wall of the hole 51 in the connector pin 50. Thus, the coil wire 31 is electrically connected from its insulator-removed portion to the cotter pin 40, the latter being also electrically connected to the connector pin 50 and further to the coaxial cable 100 from the end of said connector pin 50. The coil bobbin 20 is sheathed by the coil sleeve 70 which is securedly disposed between the underside of the flange 15 of the upper snap-in base 10 and the upperside of the flange 84 of the lower snap-in base 80. When the externally threaded lobe 101 of the coaxial cable 100 is engaged with the corresponding internally threaded hole 83 in the lower snap-in base 80, the pin 102 of the coaxial cable 100 is inserted into the hole 52 at the end of the connector pin 50, whereby the coaxial cable 100 is connected to the connector pin 50. The other end of said coaxial cable 100 is connected to a coaxial connector 103 which, in turn, is connected to a receiver/transmitter.

What is claimed is:

1. A loading coil for antenna comprising in combination a coil bobbin consisting of a densely wire-winding portion around which the coil wire is wound densely and a sparsely wire-winding portion provided below and in continuance to said densely winding portion and provided with a spiral groove along which the coil wire is wound sparsely, said sparsely winding portion having formed at its upper end a hole extending horizontally in registration with the topmost end of said spiral groove and also having formed centrally thereof a through-hole extending vertically along the length thereof, an upper snap-in base secured to the top end of said coil bobbin and having connected thereto the upper end of the coil wire, a connector pin inserted into said through-hole in said coil bobbin and positioned such that a hole formed toward the upper end of said pin is in registration with said horizontal hole in said coil bobbin, said connector pin having formed at its lower end a slitted hole, a ring secured to the bottom end of said coil bobbin and having connected thereto the lower end of the coil wire, a cotter pin inserted into and fixed in said horizontal hole in the coil bobbin, said cotter pin having an internally threaded and slitted inner wall adapted to hold and electrically connect the coil wire, a screw inserted into said horizontal hole in the coil bobbin from the opposite end thereof and threadedly engaged with said cotter pin, said cotter pin being spread out by said screw and thereby electrically connected to the connector pin, a lower snap-in base secured to said ring, said base having provided centrally in its upper portion a hole and also having provided centrally in its lower portion an internally threaded hole, and a coil sleeve securely interposed between said upper and lower snap-in bases.

* * * * *